US011221571B2

(12) United States Patent
Okuno

(10) Patent No.: US 11,221,571 B2
(45) Date of Patent: Jan. 11, 2022

(54) DEVELOPING DEVICE AND IMAGE FORMING APPARATUS

(71) Applicant: FUJIFILM Business Innovation Corp., Tokyo (JP)

(72) Inventor: Taichiro Okuno, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/839,272

(22) Filed: Apr. 3, 2020

(65) Prior Publication Data

US 2021/0096482 A1 Apr. 1, 2021

(30) Foreign Application Priority Data

Sep. 30, 2019 (JP) ..... JP2019-178704

(51) Int. Cl.
*G03G 15/08* (2006.01)
*G03G 15/09* (2006.01)

(52) U.S. Cl.
CPC ..... *G03G 15/0891* (2013.01); *G03G 15/09* (2013.01)

(58) Field of Classification Search
CPC ..... G03G 15/0891; G03G 15/09
See application file for complete search history.

(56) References Cited

U.S. PATENT DOCUMENTS

2015/0331355 A1* 11/2015 Wada ..... G03G 15/556 399/30
2016/0070205 A1 3/2016 Murata et al.
2016/0070208 A1* 3/2016 Kikuchi ..... G03G 15/0891 399/254
2017/0320687 A1* 11/2017 Kamichi ..... B65H 29/125

FOREIGN PATENT DOCUMENTS

JP 2000-242080 A 9/2000
JP 2016-057600 A 4/2016

* cited by examiner

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

A developing device includes a developing housing, a developing unit, and a transport unit. The developing housing includes a container chamber containing a developer. The developing unit rotates around a first rotation axis while carrying the developer on a surface thereof to deliver the developer. At least a partial region of the developing unit is exposed from the developing housing in a developing region below the first rotation axis such that the developing unit faces an image carrier. The developing unit develops an electrostatic latent image. The transport unit is disposed in the container chamber. The transport unit rotates around a second rotation axis to transport the developer. A part of an inner wall surface of the container chamber on a developer lifting side in which the surface of the developing unit moves toward the transport unit is located between a first plane and a second plane.

18 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-178704 filed Sep. 30, 2019.

BACKGROUND

1. Technical Field

The present disclosure relates to a developing device and an image forming apparatus.

2. Related Art

In order to shorten a supply path for supplying a toner in a toner cartridge to a developing device and reduce the size of the developing device, such a configuration has been studied that the developing device is disposed above an image carrier. Here, irrespective of a position of the developing device with respect to the image carrier, it is necessary to supply sufficiently stirred developer to a developing region near the image carrier. However, when the developing device is disposed above the image carrier, the developing region is located below, so that the developer after being supplied to the developing region and subjected to development needs to be lifted upward. Since it is necessary to lift the developer, a developing device having some structure does not circulate the developer well, and developer puddle is formed, which may lead to an image defect.

JP-A-2000-242080 discloses a developing device disposed above an image carrier. In the developing device disclosed in JP-A-2000-242080, a developer is lifted upward using plural rollers.

SUMMARY

Aspects of non-limiting embodiments of the present disclosure relate to providing a developing device that reduces image defects even though the developing device is disposed above a rotation axis of an image carrier, with a simpler structure than the structure of JP-A-2000-242080 in which the developer is lifted up using the plural rollers, and an image forming apparatus including the developing device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a developing housing including a container chamber containing a developer including a toner and a magnetic carrier; a developing unit configured to rotate around a first rotation axis while carrying the developer on a surface of the developing unit so as to deliver the developer in a rotation direction, at least a partial region of the developing unit being exposed from the developing housing in a developing region below the first rotation axis such that the developing unit faces an image carrier, the developing unit being configured to develop an electrostatic latent image on the image carrier with the toner in the developer; and a transport unit disposed in the container chamber, the transport unit being configured to rotate around a second rotation axis that is above the first rotation axis so as to transport the developer in a second rotation axis direction, in which a part of an inner wall surface of the container chamber on a developer lifting side in which the surface of the developing unit moves toward the transport unit is located between a first plane and a second plane, the first plane is tangent to a developer lifting region of the developing unit that moves toward the transport unit, and is tangent to the transport unit without passing through a facing region between the developing unit and the transport unit, and the second plane includes the first rotation axis and the second rotation axis.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described.

Figure 1:
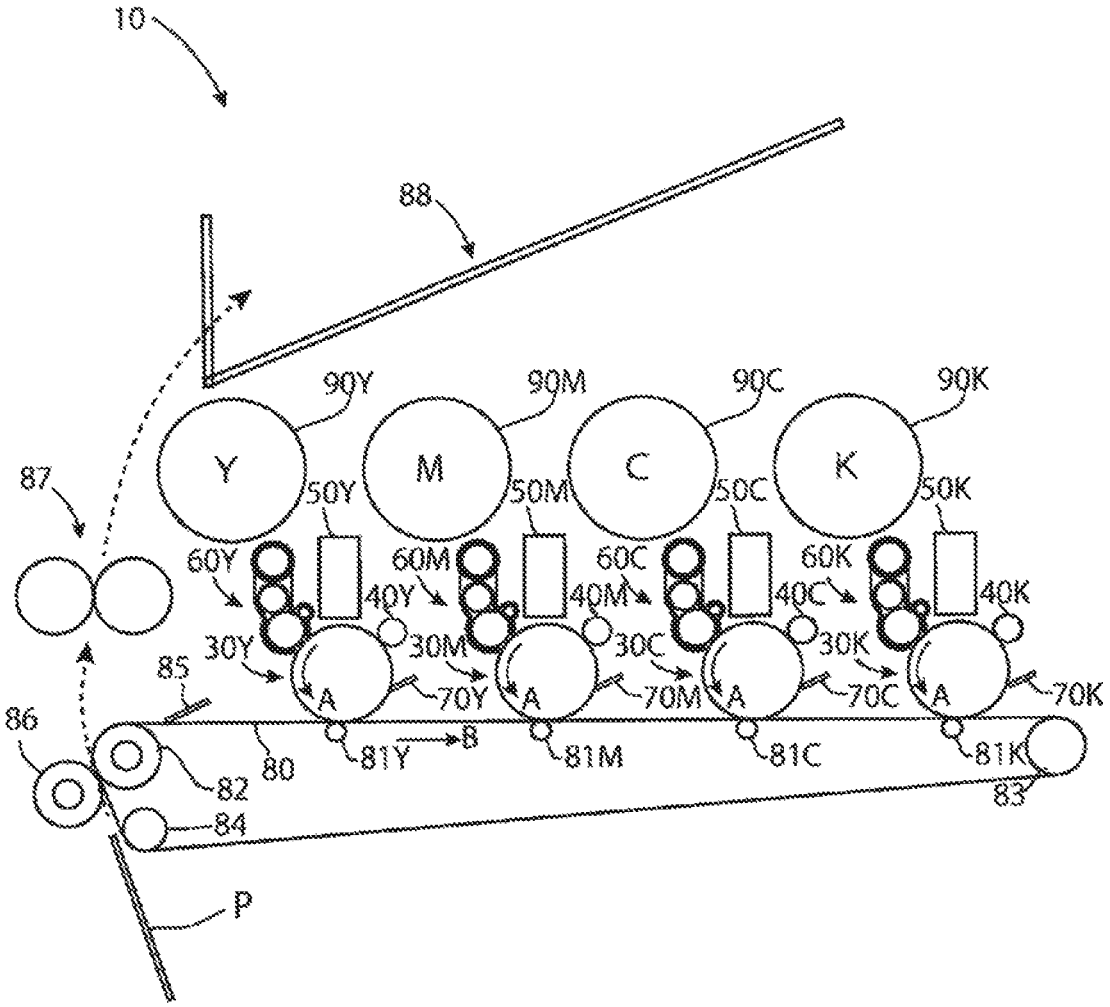
FIG. 1 is a schematic diagram illustrating an outline of an image forming apparatus according to an exemplary embodiment of the present disclosure.

FIG. 1 is a schematic diagram illustrating an outline of an image forming apparatus according to an exemplary embodiment of the present disclosure. This image forming apparatus includes a developing device according to the exemplary embodiment of the present disclosure.

An image forming apparatus 10 includes four image forming engines 20Y, 20M, 20C, 20K. Here, Y, M, C, K represent colors of toners. Y, M, C, K are respectively yellow, magenta, cyan, and black. In the following description, a common description that is not related to the colors of the toners will use the term "image forming engine 20" with symbols of Y, M, C, K omitted. The same applies to components other than the image forming engine 20.

Each image forming engine 20 includes an image carrier 30 that rotates in a direction of an arrow A. Each image forming engine 20 includes a charging unit 40, an exposure unit 50, a developing unit 60, and a cleaner 70 around the image carrier 30. A primary transfer unit 81 is provided at a position where the primary transfer unit 81 face the image carrier 30 with an intermediate transfer belt 80 (which will be described later) interposed therebetween. The developing unit 60 is an example of a developing device of the present disclosure.

The intermediate transfer belt 80 is an endless belt wound around plural rollers 82, 83, 84. The intermediate transfer belt 80 is circulated in a direction indicated by an arrow B on a circulation path that travels along the four image carriers 30. A cleaner 85 is provided that cleans the intermediate transfer belt 80.

The image forming apparatus 10 includes a secondary transfer unit 86, a fixing unit 87, and an ejection tray 88. A toner cartridge 90 is provided immediately above each image forming engine 20.

Each image carrier 30 is charged by the charging unit 40, and an electrostatic latent image is formed by exposure by the exposure unit 50. This electrostatic latent image is developed with a toner in a developer including the toner and a magnetic carrier in the developing unit 60. A toner image formed on the image carrier 30 by the development is transferred onto the intermediate transfer belt 80 by an operation of the primary transfer unit 81. Four image forming engines 20 are provided. Toner images are formed with the respective color toners on the respective image carriers 30 provided in the respective image forming engines 20. The toner images are transferred so as to sequentially overlap one another as the intermediate transfer belt 80 moves. Residual toner on the image carrier 30 after the transfer is removed by the cleaner 70. When the toner in the developing unit 60 is reduced due to the development, the toner is supplied from the toner cartridge 90. The toner cartridge 90 is detachable. The toner cartridge 90 is replaced with a new toner cartridge 90 when the toner cartridge 90 becomes empty.

A sheet P is taken out from a sheet tray (not illustrated). At a timing when the toner image transferred onto the intermediate transfer belt 80 reaches a position where the intermediate transfer belt 80 faces the secondary transfer unit 86, the sheet P is transported to the same position. Then, the toner image transferred onto the intermediate transfer belt 80 is transferred onto the sheet P by an operation of the secondary transfer unit 86.

The sheet P onto which the toner image is transferred is further transported, and heated and pressed by the fixing unit 87, so that the toner image on the sheet P is fixed to the sheet P. As a result, an image formed of the fixed toner image is formed on the sheet P. The sheet P on which this image is formed is further transported and output to the ejection tray 88.

In the image forming apparatus 10 of the present exemplary embodiment, the developing unit 60 is disposed above the image carrier 30. For this reason, a distance between the toner cartridge 90 disposed above the developing unit 60 and the developing unit 60 is short. This means that a toner supply path (not illustrated) from the toner cartridge 90 to the developing unit 60 is short, which allows for reduction in size of the developing unit 60. However, in this case, it is necessary to deal with issues which will be described later.

Figure 2:
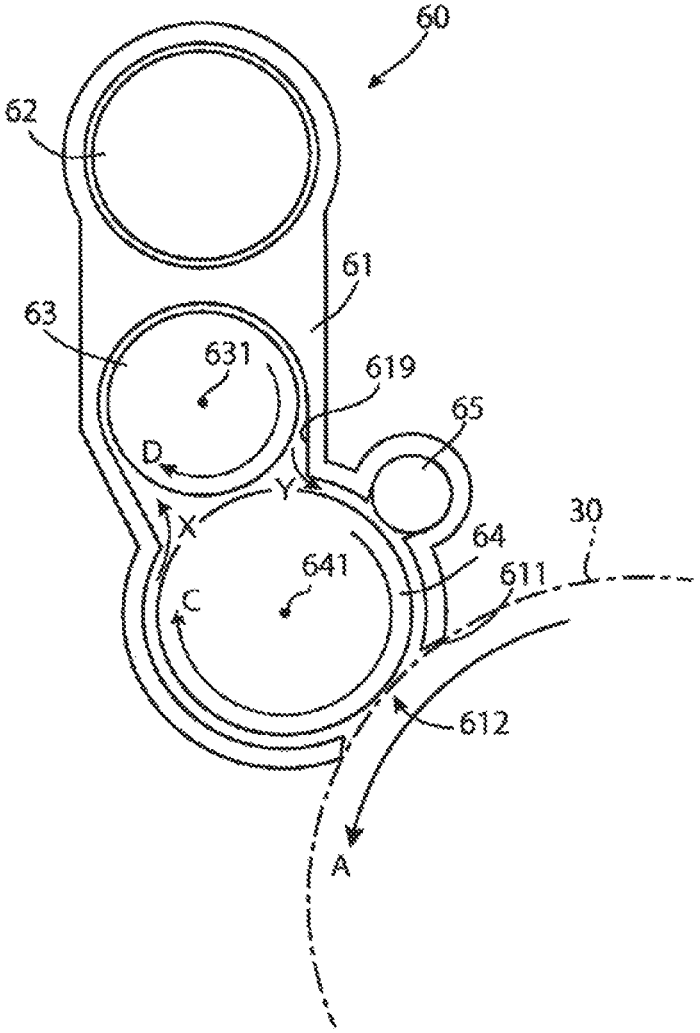
FIG. 2 is an enlarged schematic diagram of a developing device constituting the image forming apparatus of FIG. 1.

FIG. 2 is an enlarged schematic diagram of the developing unit constituting the image forming apparatus of FIG. 1. In FIG. 2 and subsequent figures, the symbols of Y, M, C, K that represent the colors will be omitted.

The developing unit 60 includes two augers 62, 63, a developing roller 64, and a trimmer 65 in a housing 61. The two augers 62, 63 transport the developer including the toner and the magnetic carrier in the housing 61 in directions that are perpendicular to the sheet of FIG. 2 and opposite to each other, while stirring the developer. As a result, the developer is circulated in the housing 61. The developing roller 64 is disposed immediately below the lower auger 63. No partition wall is provided between the developing roller 64 and the auger 63 immediately above the developing roller 64. The auger 63 and the developing roller 64 are disposed in the same container chamber 619 in the housing 61.

A developing opening 611 is opened at a position obliquely downward of the housing 61. The developing unit 60 is provided with a posture that the developing roller 64 and the image carrier 30 are disposed close to each other in a developing region 612 where the developing opening 611 is opened.

The image carrier 30 rotates in the direction of the arrow A as illustrated in FIG. 1. Accordingly, the developing roller 64 rotates around a rotation axis 641 in a direction of an arrow C, and the lower auger 63 rotates around a rotation axis 631 in a direction of an arrow D.

The developer circulating in the housing 61 while being stirred by the two augers 62, 63 is delivered from the lower auger 63 to the developing roller 64 in a direction of an arrow Y. Then, due to rotation of the developing roller 64 in the direction of the arrow C, the developer is transported in the same direction as the arrow C. Then, a layer thickness of the developer is regulated by the trimmer 65, the developer reaches the developing region 612 where the developer faces the image carrier 30, and the electrostatic latent image on the image carrier 30 is developed with the toner in the developer.

The developer after the development is further transported along the arrow C, delivered to the auger 63 in a direction indicated by an arrow X, and stirred with the developer existing on the auger 63 again and circulated.

The developing roller 64 corresponds to an example of a developing unit according to the present disclosure. The rotation axis 641 of the developing roller 64 corresponds to an example of a first rotation axis according to the present disclosure. The auger 63 immediately above the developing roller 64 corresponds to an example of a transport unit according to the present disclosure. The rotation axis 631 of the auger 63 corresponds to an example of a second rotation axis according to the present disclosure.

The issues that arise when a developing unit of a related art is applied to the image forming apparatus 10 of the type illustrated in FIG. 1 will be described.

Figure 3A:
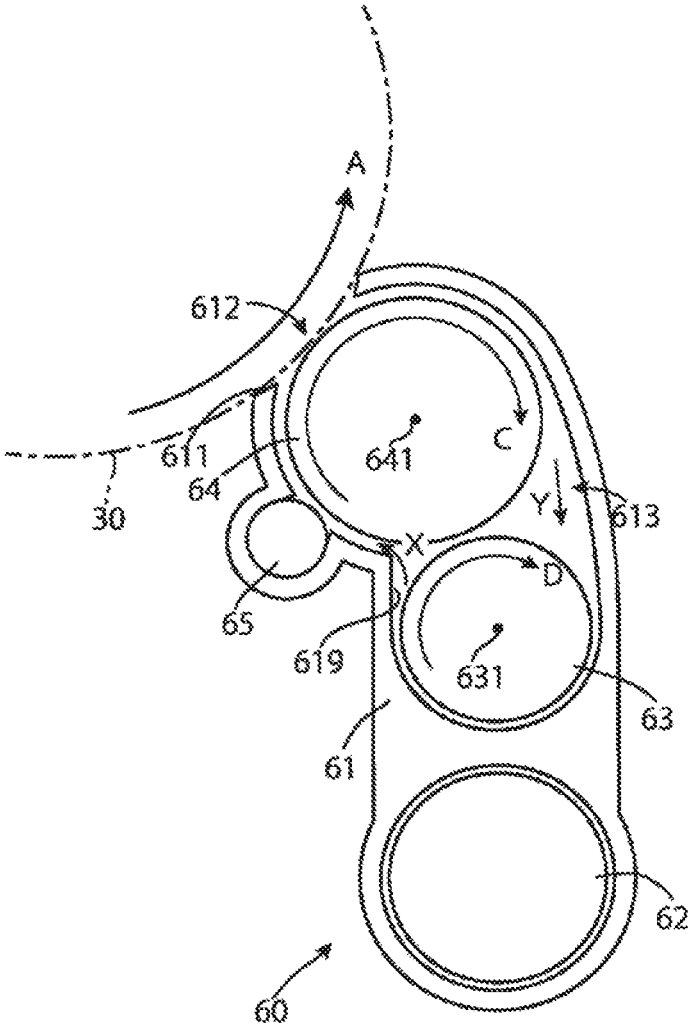
FIG. 3A is a diagram illustrating an arrangement example of a developing unit of related art.
Figure 3B:
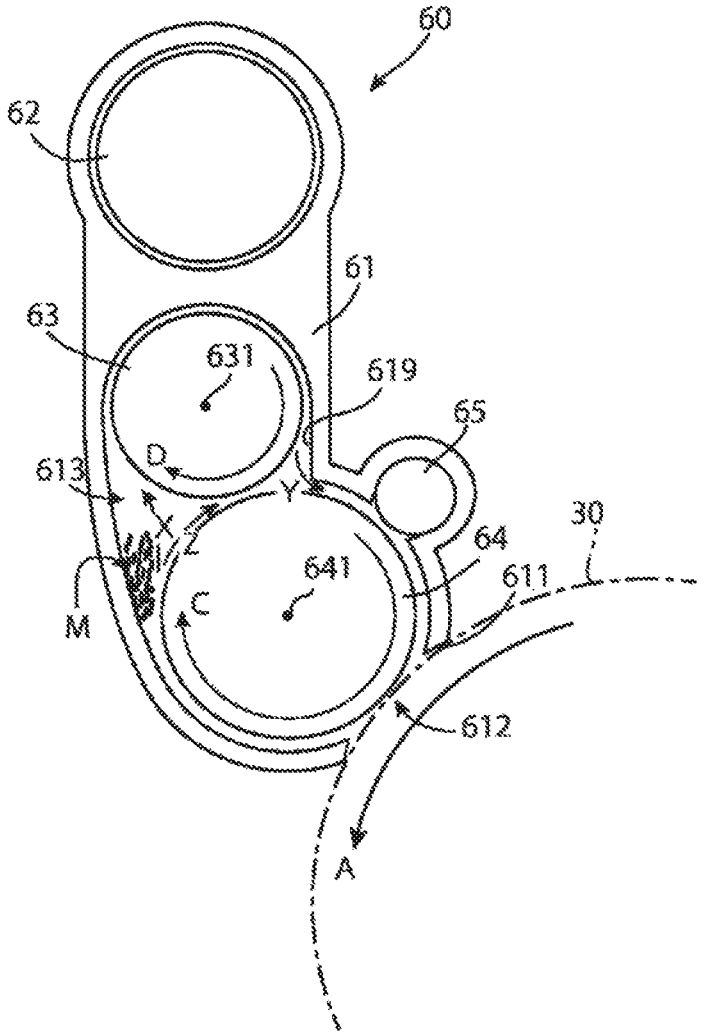
FIG. 3B is a diagram illustrating an arrangement example in which the developing unit of the related art is turned upside down so as to be applied to the image forming apparatus of FIG. 1.

FIG. 3A is a diagram illustrating an arrangement example of the developing unit of the related art. FIG. 3B is a diagram illustrating an arrangement example in which the developing unit of the related art is turned upside down so as to be applied to the image forming apparatus of FIG. 1. The developing units illustrated in FIGS. 3A and 3B correspond to a comparative example of the present disclosure. In the description of FIG. 3 and the subsequent drawings, the same reference numerals as those assigned to the developing unit and respective elements illustrated in FIG. 2 will be used, and only differences will be described.

FIG. 3A illustrates a general arrangement example of the related art in which the developing unit 60 is disposed below the image carrier 30. In the developing unit 60, a space 613 larger than that in FIG. 2 is formed at a position in the container chamber 619 where the developer after being used in the development is delivered from the developing roller 64 to the auger 63. The developer after being used in the development passes through the space 613 and is delivered from the developing roller 64 to the auger 63. For this reason, a larger space 613 results in more smooth delivery of the developer.

In the arrangement of FIG. 3A, the image carrier 30 is disposed above the developing unit 60, and the intermediate transfer belt 80 (see FIG. 1) is disposed above the developing unit 60. The toner cartridge 90 (see FIG. 1) also needs to be disposed above the developing unit 60 so as to implement the toner supply path to the developing unit 60 with a simple structure using gravity. Therefore, in the configuration in FIG. 3A, it is necessary to provide the toner cartridge 90 further above the intermediate transfer belt 80. As a result, with this configuration, the toner supply path becomes long, which is disadvantageous for reduction in size of the developing unit 60.

Then, as illustrated in FIG. 3B, the developing unit 60 is turned upside down, and the developing unit 60 is disposed above the image carrier 30. In this configuration, the intermediate transfer belt 80 is disposed further below the image carrier 30 as illustrated in FIG. 1, so that the toner cartridge 90 can be disposed immediately above the developing unit 60, the supply path can be shortened, and the size of the developing unit 60 can be reduced.

However, when the developing unit 60 is disposed above the image carrier 30, it is necessary to deliver the developer from the developing roller 64 to the auger 63 while the developer is lifted upward. As illustrated in FIG. 3B, when the developing unit 60 of the related art illustrated in FIG. 3A is turned upside down as it is, the large space 613 is formed at the position where the developer is delivered from the developing roller 64 to the auger 63. Then, the developer may not be delivered smoothly from the developing roller 64 to the auger 63, and a part of the developer may become a developer puddle M and remain in the space 613. When the developer puddle M is generated there, a part of the developer in the developer puddle M or a part of the developer that is about to be newly delivered from the developing roller 64 to the auger 63 is moved in a direction of an arrow Z, then is moved along with the developer newly delivered from the auger 63 to the developing roller 64 in the direction of the arrow Y to reach the developing region 612, and may be used to develop the electrostatic latent image on the image carrier 30. The developer used in developing has a lower ratio of the toner to the magnetic carrier, and can be reused only after being sufficiently stirred while being circulated by the two augers 62 and 63. Therefore, as described above, when the developer moves in the direction of the arrow Z and is used in the development without being delivered to the auger 63, an image defect may occur. The developing unit 60 of the present exemplary embodiment has a structure in which occurrence of this image defect is prevented.

Figure 4:
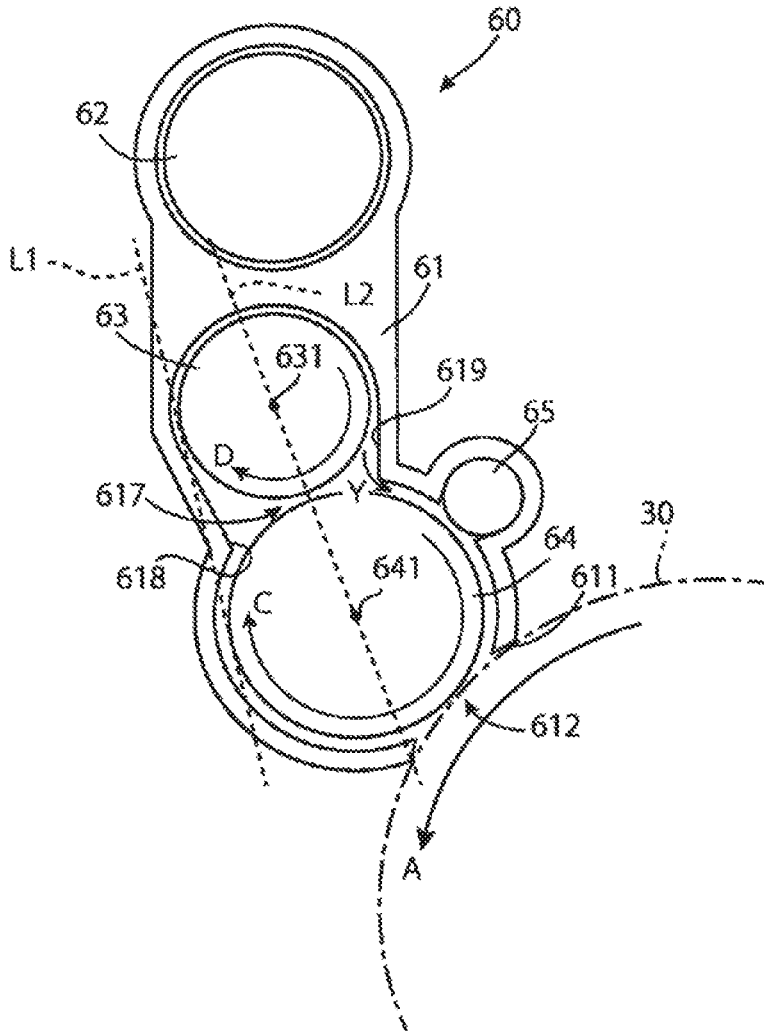
FIG. 4 is a schematic diagram of a developing unit according to a first example of the present exemplary embodiment, which is also illustrated in FIG. 2.

FIG. 4 is a schematic diagram of a developing unit according to a first example of the present exemplary embodiment also illustrated in FIG. 2. Here, the configuration of the developing unit of the first example will be described with reference to FIG. 4.

A plane L1 is tangent to a developer lifting region of the developing roller 64 (a region of the developing roller 64 on the left side of FIG. 4) that moves toward the auger 63 and is tangent to the auger 63. Here, as a plane satisfying this condition, a plane L1' is present in addition to the plane L1. Of those two planes L1 and L1', the plane L1 tangent to the auger 63 without passing through a facing area 617 where the developing roller 64 and the auger 63 face each other will be discussed.

A plane L2 includes both the rotation axis 641 of the developing roller 64 and the rotation axis 631 of the auger 63.

A part of an inner wall surface 618 of the container chamber 619 on a developer lifting side (the left side in FIG. 4) in which a surface of the developing roller 64 moves toward the auger 63 is located between the plane L1 and the plane L2. These planes L1 and L2 correspond to examples of a first plane and a second plane according to the present disclosure, respectively.

In this way, the space 613 (see FIG. 3) on the developer lifting side in the container chamber 619 is narrowed down to a level where a part of the inner wall surface 618 of the container chamber 619 illustrated in FIG. 4 is located between the plane L1 and the plane L2. Then, image defect can be prevented with a simple configuration as compared with the configuration disclosed in JP-A-2000-242080 in which the plural rollers are used to lift the developer upward.

Figure 5:
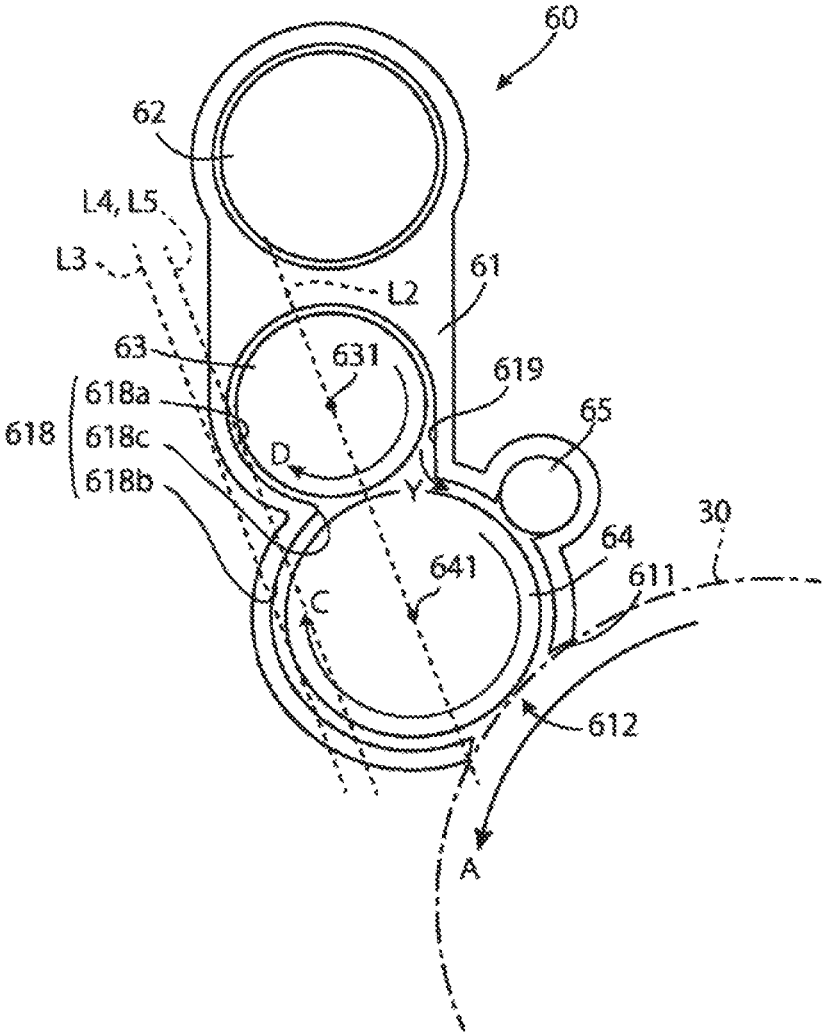
FIG. 5 is a schematic diagram of a developing unit according to a second example of the present exemplary embodiment.

FIG. 5 is a schematic diagram of a developing unit according to a second example of the present exemplary embodiment.

Same as above, the plane L2 includes both the rotation axis 641 of the developing roller 64 and the rotation axis 631 of the auger 63.

A plane L3 is tangent to the developing roller 64 on the developer lifting side and extends in parallel with the plane L2. A plane L4 is tangent to the auger 63 on the developer lifting side and extends in parallel with the plane L2. A plane closer to the plane L2 among these two planes L3 and L4 will be referred to as a "plane L5" (in the illustrated example, the plane L4 is the plane L5).

A part of the inner wall surface 618, on the developer lifting side, of the container chamber 619 of the developing unit 60 illustrated in FIG. 5 is located between the plane L5 and the plane L2. According to the developing unit 60 of FIG. 5, image defects can be further reduced as compared with the case where the part of the inner wall surface 618 of the container chamber 619 on the developer lifting side is located between the plane L1 and the plane L2 but no part of the inner wall surface 618 of the container chamber 619 on the developer lifting side is located between the plane L5 and the plane L2 as illustrated in FIG. 4. The planes L3, L4, L5 correspond to examples of a third plane, a fourth plane, and a fifth plane according to the present disclosure, respectively.

In the developing unit 60 of FIG. 5, the plane L4 which is closer to the plane L2 among the two planes L3 and L4 is the plane L5. This means that the auger 63 has a smaller diameter than the developing roller 64. When the diameter of the auger 63 is small, the developer delivered from the developing roller 64 is separated from the developing roller 64 in a short distance. Therefore, the developer lifted by the developing roller 64 can be more easily delivered to the auger 63 than in a case where the plane L3 is the plane L5, that is, the auger 63 has a larger diameter than the developing roller 64.

In the developing unit 60 of FIG. 5, the inner wall surface 618 of the container chamber 619 on the developer lifting side includes an arc-shaped inner wall surface 618*a* extending so as to face the developing roller 64, an arc-shaped inner wall surface 618*b* extending so as to face the auger 63, and a connection inner wall surface 618*c* that is located between the plane L1 and plane L2 and connects the two arc-shaped inner wall surfaces 618*a*, 618*b*. The arc-shaped inner wall surfaces 618*a*, 618*b* correspond to examples of a first arc-shaped inner wall surface and a second arc-shaped inner wall surface according to the present disclosure, respectively.

The inner wall surface 618, on the developer lifting side, of the container chamber 619 of the developing unit 60 illustrated in FIG. 5 is arc-shaped inner wall surfaces, except for the connection inner wall surface 618*c* located between the plane L1 and the plane L2. For this reason, accumulation of the developer is further prevented as compared with a case where the inner wall has a shape other than the arc shape.

In both of the developing unit 60 of FIG. 4 and the developing unit 60 of FIG. 5, the rotation axis 641 of the developing roller 64 is located obliquely below the rotation axis 631 of the auger 63 such that the developer lifting side (the left side in FIGS. 4 and 5) is the plane L2 directed obliquely downward.

When the plane L2 is directed obliquely downward, a height to which the developer needs to be lifted in order to deliver the developer from the developing roller 64 to the auger 63 can be made small as compared to a case where the plane L2 is horizontal or is directed obliquely upward. For this reason, the developer is easily delivered to the auger 63, and therefore, the developer after being used in developing can be prevented from being supplied to the developing region again as it is.

In the exemplary embodiments of FIGS. 4 and 5, in addition to the plane L2 being directed obliquely downward, the auger 63 has a smaller diameter than the developing roller 64, so that the developer is more easily delivered to the auger 63.

Figure 6:
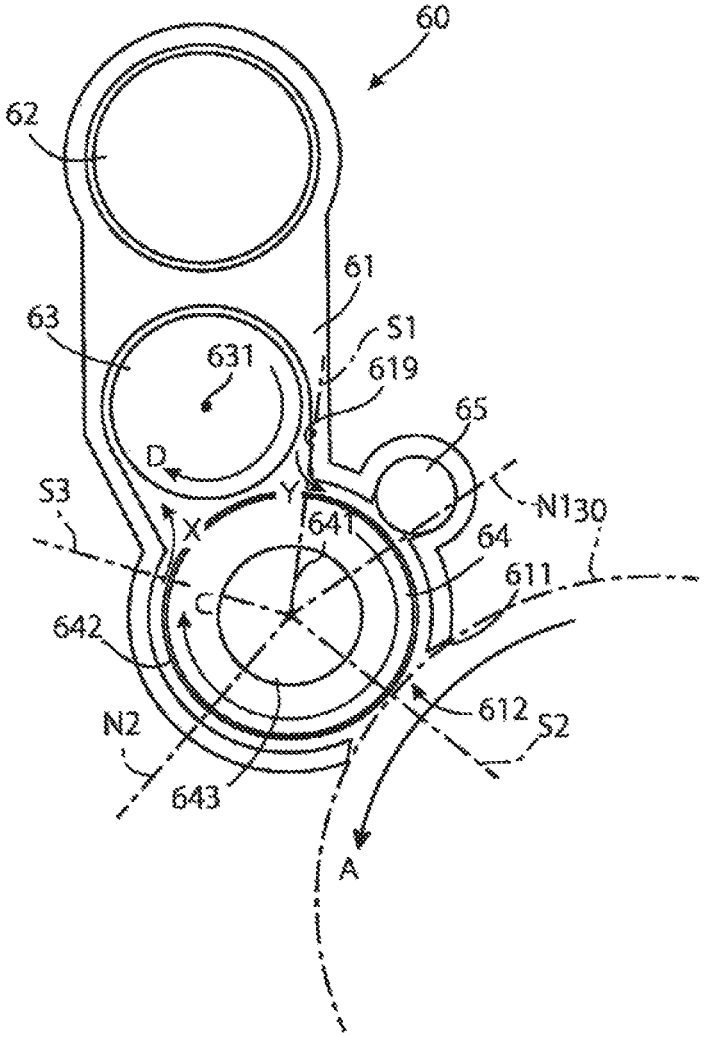
FIG. 6 is a schematic diagram of a developing device according to the first example of the present exemplary embodiment, which is also illustrated in FIG. 2.

FIG. 6 is a schematic diagram of the developing unit according to the first example of the present exemplary embodiment which is also illustrated in FIG. 2. The developing unit of the first example will be further described with reference to FIG. 6.

FIG. 6 illustrates a developing sleeve 642 and a fixed magnet 643 that constitute the developing roller 64. The developing sleeve 642 has a cylindrical shape. The developing sleeve 642 rotates in the direction of the arrow C with the developer carried on a surface of the developing sleeve 642. The developing sleeve 642 corresponds to an example of a cylindrical portion of the present disclosure. The fixed magnet 643 is a magnet having plural magnetic poles and is fixed so as not to rotate even when the developing sleeve 642 rotates. A pick-up magnetic pole S1, a trimming magnetic pole N1, a main magnetic pole S2, a transport magnetic pole N2, and a pick-off magnetic pole S3 are illustrated as the magnetic poles. The description will focus on the pick-off magnetic pole S3. The pick-off magnetic pole S3 is a magnetic pole that serves to separate the developer lifted on the surface of the developing sleeve 642 from the developing sleeve 642.

In the example illustrated in FIG. 6, the pick-off magnetic pole S3 is directed upward with respect to a horizontal plane. Therefore, the developer lifted on the surface of the developing sleeve 642 is further lifted by the pick-off magnetic pole S3. As described above, the pick-off magnetic pole S3 directed upward with respect to the horizontal plane contributes to smooth delivery of the developer to the auger 63. That is, image defects are further reduced as compared with a case where the pick-off magnetic pole S3 is directed horizontally or downward.

The developing unit of the first example is described with reference to FIG. 6. It is noted that the description which is made with reference to FIG. 6 is applicable to the second example illustrated in FIG. 5.

A so-called tandem image forming apparatus including the intermediate transfer belt 80 has been described. It is noted that the developing device of the present disclosure is applicable to image forming apparatuses other than the tandem image forming apparatus, such as an image forming apparatus that forms a so-called monochrome image.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a developing housing including a container chamber configured to contain a developer including a toner and a magnetic carrier;

a developing unit configured to rotate around a first rotation axis while carrying the developer on a surface of the developing unit so as to deliver the developer in a rotation direction, wherein at least a partial region of the developing unit is exposed from the developing housing in a developing region below the first rotation axis such that the developing unit faces an image carrier, and wherein the developing unit is configured to develop an electrostatic latent image on the image carrier with the toner in the developer; and a transport unit disposed in the container chamber, wherein the transport unit is configured to rotate around a second rotation axis that is above the first rotation axis so as to transport the developer in a second rotation axis direction, wherein a part of an inner wall surface of the container chamber on a developer lifting side in which the surface of the developing unit moves toward the transport unit is located between a first plane and a second plane, wherein the part of the inner wall surface of the container chamber is above the first rotation axis, wherein the first plane is tangent to a developer lifting region of the developing unit configured to lift developer toward the transport unit, wherein the first plane is tangent to the transport unit without passing through a facing region between the developing unit and the transport unit, wherein the second plane includes the first rotation axis and the second rotation axis, and wherein the second plane passes through the image carrier.

2. The developing device according to claim 1, wherein the part of the inner wall surface of the container chamber on the developer lifting side is located between the second plane and a fifth plane, wherein the fifth plane is one closer to the second plane among a third plane and a fourth plane, wherein the third plane extends parallel to the second plane and is tangent to the developing unit on the developer lifting side, and wherein the fourth plane extends parallel to the second plane and is tangent to the transport unit on the developer lifting side.

3. The developing device according to claim 2, wherein the fourth plane is the fifth plane.

4. An image forming apparatus comprising:
the developing device according to claim 3,
wherein the image forming apparatus is configured such that a toner image formed by the developing device developing the electrostatic latent image on the image carrier is transferred and fixed to a sheet.

5. An image forming apparatus comprising:
the developing device according to claim 2,
wherein the image forming apparatus is configured such that a toner image formed by the developing device developing the electrostatic latent image on the image carrier is transferred and fixed to a sheet.

6. The developing device according to claim 1, wherein the inner wall surface of the container chamber on the developer lifting side comprises:
a first arc-shaped inner wall surface extending so as to face the developing unit,
a second arc-shaped inner wall surface extending so as to face the transport unit, and
a connection inner wall surface that is located between the first plane and the second plane and that connects the first arc-shaped inner wall surface and the second arc-shaped inner wall surface.

7. An image forming apparatus comprising:
the developing device according to claim 6,
wherein the image forming apparatus is configured such that a toner image formed by the developing device developing the electrostatic latent image on the image carrier is transferred and fixed to a sheet.

8. The developing device according to claim 1, wherein the first rotation axis is located obliquely below the second rotation axis such that the developer lifting side is the second plane directed obliquely downward.

9. The developing device according to claim 8, wherein the transport unit has a smaller diameter than the developing unit.

10. An image forming apparatus comprising:
the developing device according to claim 9,
wherein the image forming apparatus is configured such that a toner image formed by the developing device developing the electrostatic latent image on the image carrier is transferred and fixed to a sheet.

11. An image forming apparatus comprising:
the developing device according to claim 8,
wherein the image forming apparatus is configured such that a toner image formed by the developing device developing the electrostatic latent image on the image carrier is transferred and fixed to a sheet.

12. The developing device according to claim 1, wherein the developing unit comprises:
a cylindrical portion having a cylindrical shape, the cylindrical portion being configured to rotate with the developer being carried on a surface of the cylinder portion; and
a fixed magnet disposed in the cylinder portion, the fixed magnet including a pick-off magnetic pole configured to separate the developer which is lifted and carried on the surface of the cylinder portion, and
wherein the pick-off magnetic pole faces upward with respect to a horizontal plane.

13. An image forming apparatus comprising:
the developing device according to claim 12,
wherein the image forming apparatus is configured such that a toner image formed by the developing device developing the electrostatic latent image on the image carrier is transferred and fixed to a sheet.

14. An image forming apparatus comprising:
the developing device according to claim 1,
wherein the image forming apparatus is configured such that a toner image formed by the developing device developing the electrostatic latent image on the image carrier is transferred and fixed to a sheet.

15. The developing device according to claim 1, wherein the first rotation axis is above a rotation axis of the image carrier.

16. The developing device according to claim 1, wherein all portions of the developing unit which are exposed from the developing housing and face the image carrier, are below the first rotation axis.

17. A developing device comprising:
a developing housing means including a container chamber means for containing a developer including a toner and a magnetic carrier;
a developing means for rotating around a first rotation axis while carrying the developer on a surface of the developing means so as to deliver the developer in a rotation direction,
wherein at least a partial region of the developing means is exposed from the developing housing in a developing region below the first rotation axis such that the developing means faces an image carrier, and
wherein the developing means is for developing an electrostatic latent image on the image carrier with the toner in the developer; and
a transport means disposed in the container chamber means,
wherein the transport means is for rotating around a second rotation axis that is above the first rotation axis so as to transport the developer in a second rotation axis direction,
wherein a part of an inner wall surface of the container chamber means on a developer lifting side in which the surface of the developing means moves toward the transport means is located between a first plane and a second plane,
wherein the part of the inner wall surface of the container chamber is above the first rotation axis,
wherein the first plane is tangent to a developer lifting region of the developing means that moves toward the transport means,
wherein the first plane is tangent to the transport means without passing through a facing region between the developing means and the transport means,
wherein the second plane includes the first rotation axis and the second rotation axis, and
wherein the second plane passes through the image carrier.

18. A developing device comprising:
a developing housing including a container chamber configured to contain a developer including a toner and a magnetic carrier;
a developing roller configured to rotate around a first rotation axis while carrying the developer on a surface of the developing roller so as to deliver the developer in a rotation direction,
wherein at least a partial region of the developing roller is exposed from the developing housing in a developing region below the first rotation axis such that the developing roller faces an image carrier, and wherein the developing roller is configured to develop an electrostatic latent image on the image carrier with the toner in the developer; and an auger disposed in the container chamber, wherein the auger is configured to rotate around a second rotation axis that is above the first rotation axis so as to transport the developer in a second rotation axis direction, wherein a part of an inner wall surface of the container chamber on a developer lifting side in which the surface of the developing roller moves toward the auger is located between a first plane and a second plane, wherein the part of the inner wall surface of the container chamber is above the first rotation axis, wherein the first plane is tangent to a developer lifting region of the developing roller configured to lift developer toward the auger, wherein the first plane is tangent to the auger without passing through a facing region between the developing roller and the auger, wherein the second plane includes the first rotation axis and the second rotation axis, and wherein the second plane passes through the image carrier.

* * * * *